United States Patent [19]

Fukuda

[11] 4,298,822

[45] Nov. 3, 1981

[54] FOLDED FLUORESCENT LAMP AND SOCKET

[75] Inventor: Makoto Fukuda, Takatsuki, Japan

[73] Assignee: Matsushita Electronics Corporation, Osaka, Japan

[21] Appl. No.: 41,789

[22] Filed: May 23, 1979

[30] Foreign Application Priority Data

May 30, 1978 [JP] Japan ..... 53-65210

[51] Int. Cl.[3] ..... H01J 61/42; H01J 61/30; H01J 61/02

[52] U.S. Cl. ..... 313/493; 313/204; 313/318

[58] Field of Search ..... 313/493

[56] References Cited

U.S. PATENT DOCUMENTS 3,501,662 3/1970 Plagge ..... 313/493

3,551,736 12/1970 Doehner ..... 313/493 X 3,903,447 9/1975 Young et al. ..... 313/493

4,142,125 2/1979 Lauwerijssen et al. ..... 313/493 X

FOREIGN PATENT DOCUMENTS 1252801 10/1967 Fed. Rep. of Germany ..... 313/493

*Primary Examiner*—Robert Segal

*Attorney, Agent, or Firm*—Burgess, Ryan and Wayne

[57] ABSTRACT

A fluorescent lamp of the type comprising a U-shaped glass tube whose inside surface is coated with fluorescent materials and which is filled with mercury vapor and rare gas, two electrodes at the ends of the glass tube, and a cap or base which bridges between the ends of the glass tube. As compared with the incandescent lamps with the same wattages the luminous efficiency and lamp life are remarkably improved, and the fluorescent lamps may be made considerably compact in size.

1 Claim, 8 Drawing Figures

FIG. 5

| | THE INVENTION | | PRIOR ART | |
|---|---|---|---|---|
| | 15 W TYPE | 20 W TYPE | F15T8 | F20T12 |
| LAMP CURRENT (mA) | 300 | 375 | 300 | 375 |
| LAMP VOLTAGE (V) | 52 | 55 | 55 | 58 |
| LAMP POWER (W) | 14 | 18 | 15 | 20 |
| TOTAL LUMINOUS FLUX (ℓm) | 700 | 930 | 860 | 1250 |
| LUMINOUS EFFICINCY (ℓm/W) | 50 | 51.7 | 57.4 | 62.5 |
| L (mm) | 300 | 380 | 360 | 504 |
| D (mm) | 42 | 42 | 25.5 | 38 |
| L/D | 7.14 | 9.05 | 14.1 | 13.3 |
| TUBE WALL LOAD ($W/Cm^2$) | 0.084 | 0.085 | 0.054 | 0.040 |
| LAMP LIFE (hours) | 5000 | 5000 | 5000 | 7500 |

FIG. 6

| | THE INVENTION | PRIOR ART |
|---|---|---|
| | 15W TYPE | F15T8 |
| WIDTH OR DIAMETER (mm) | 42 | 25.5 |
| LENGTH (mm) | 190 | 436 |
| ARER OF LIGHT SOURSE D x ℓ ($Cm^2$) | 80 | 111 |
| TOTAL LUMINOUS FLUX $\phi$ (ℓm) | 700 | 860 |
| LUMENS PER SQ. CM. $\phi/S$ (ℓm/$Cm^2$) | 8.75 | 7.75 |

FIG. 7

| | THE INVENTION | PRIOR ART | |
|---|---|---|---|
| | 20W TYPE | F20T12CW | FC6T9CW |
| WIDTH OR DIAMETER (mm) | 42 | 38 | 32 |
| DIAMETER OR LENGTH ($\ell$) OF GLASS TUBE | 230 | 588 | 210 |
| ARER OF LIGHT SOURSE $D \times \ell$ ($Cm^2$) | 96 | 224 | 345 |
| TOTAL LUMINOUS FLUX $\phi$ ($\ell m$) | 930 | 1250 | 1070 |
| LUMENS PER SQ. CM. $\phi/S$ ($\ell m/Cm^2$) | 9.7 | 5.6 | 3.62 |

FIG. 8

| | THE INVENTION | PRIOR ART |
|---|---|---|
| | 6W TYPE | F6T5CW |
| LAMP CURRENT (mA) | 142 | 147 |
| LAMP VOLTAGE (V) | 46.2 | 45 |
| LAMP POWER (W) | 6.5 | 6.0 |
| TOTAL LUMINOUS FLUX (ℓm) | 220 | 240 |
| LUMINOUS EFFICINCY (ℓm/W) | 33.7 | 40 |
| L (mm) | 208 | 160 |
| D (mm) | 28 | 15.5 |
| L/D | 6.92 | 10.3 |
| TUBE WALL LOAD ($W/Cm^2$) | 0.084 | 0.083 |
| LAMP LIFE (hours) | 3000 | 3000 |

FOLDED FLUORESCENT LAMP AND SOCKET

BACKGROUND OF THE INVENTION

The present invention relates to generally fluorescent lamps whose inside surface is coated with fluorescent materials and which are filled with mercury vapor and rare gas and more particularly U-shaped fluorescent lamps which are extremely compact in size.

Of all the light sources the incandescent lamps have the highest degrees of freedom in design. In other words they are superior in compactness to other light sources. As a result they have been widely used in various fields. However their luminous efficiency and lamp life are about 1/5 of those of the fluorescent lamps so that from the standpoint of efficient use of energy they are disadvantageous.

The fluorescent lamps may be divided in general into the straight and circular types, but both the types are not so compact as to be used instead of the incandescent lamps.

SUMMARY OF THE INVENTION

One of the objects of the present invention is therefore to provide a fluorescent lamp whose luminous efficiency and lamp life are by far superior to those of the incandescent lamps and which may be made very compact in size so that the fluorescent lamps may be used instead of the incandescent lamps.

Another object of the present invention is to provide a fluorescent lamps which may be fabricated in a very simple manner.

A further object of the present invention is to provide a fluorescent lamp which has a cap or base adapted to correctly hold the ends of the glass tube.

A still further object of the present invention is to provide a fluorescent lamp which is provided with cap or base prongs which may be received in the conventional holders for the circular fluorescent lamps.

BRIEF DESCRIPTION OF THE DRAWINGS

FIGS. 5 and 8 show tables illustrating various data for comparison between the fluorescent lamps in accordance with the present invention and the prior art straight fluorescent lamps; and FIGS. 6 and 7 show tables of data used for the comparison in lumens per sq.cm. between the fluorescent lamps in accordance with the present invention and the prior art fluorescent lamps.

DESCRIPTION OF THE PREFERRED EMBODIMENT

Figure 1:
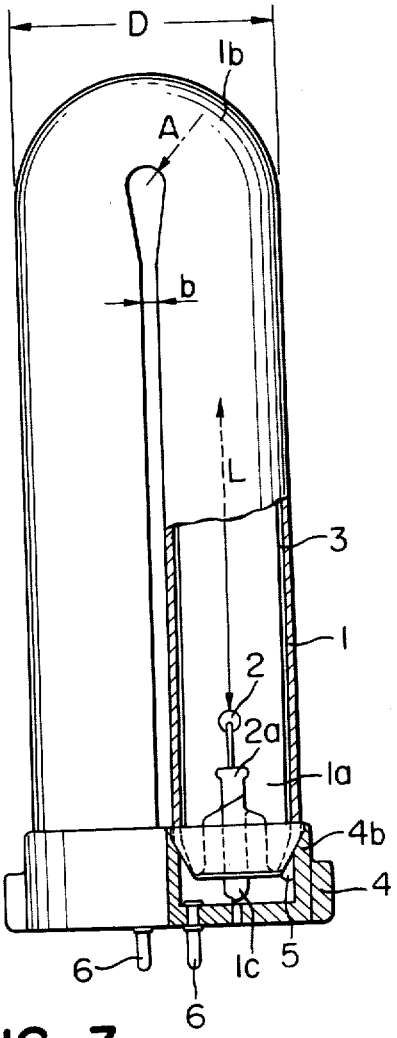
FIG. 1 is a front view, partly in section, of a preferred embodiment of a fluorescent lamp in accordance with the present invention.
Figure 2:
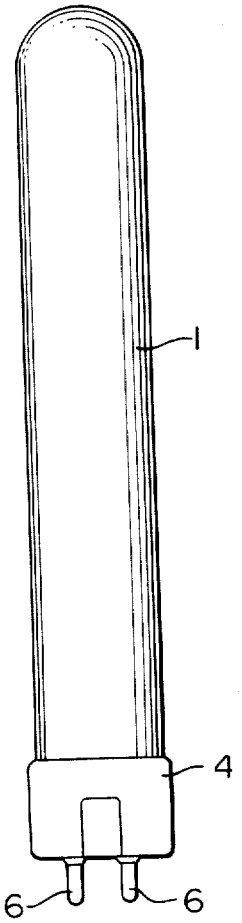
FIG. 2 is a side view thereof.
Figure 3:
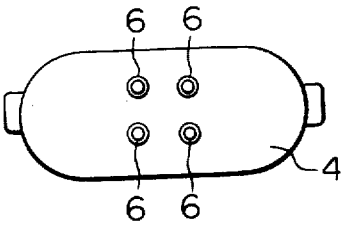
FIG. 3 is a bottom view thereof.

Referring to FIGS. 1–4, a fluorescent lamp in accordance with the present invention consists of a glass tube 1, electrodes 2, a phosphor coating 3, a base 4, adhesives 5 and terminal pins 6.

In this specification the compactness of the fluorescent lamps is expressed in terms of the ratio L/D, where L is the distance in mm between two electrodes 2 at the ends of the U-shaped glass tube 1 and D is the outer width in mm of the glass tube 1.

Whereas the ratio L/D of the U-shaped fluorescent lamps in accordance with the present invention is between 3 and 10, the ratio L/D of the straight fluorescent lamps is in general in excess of 10. The reason is that since the width D of the fluorescent lamp in accordance with the present invention is more than two times as large as the outer diameter of the glass tube 1, the ratio L/D may be considerably reduced as compared with the straight fluorescent lamps and therefore the fluorescent lamp in accordance with the present invention may be highly compact in size. However if the ratio L/D is lower than three, the distance between the electrodes 2 becomes too short so that the lamp current density exceedingly increases, resulting in a short lamp life. Furthermore if a ballast with a ballast specified to the lamp ballast were used, the result would be the overheating of the ballast and consequently a short life.

The width D is determined to be less than 60 mm because the maximum diameter of the 60 W incandescent lamps which are most universally used is 60 mm.

In order to attain higher compactness, the shorter the distance d between the legs of the U-shaped glass tube 1, the better, but from the standpoint of production, the distance must be longer than 0.5 mm. The reason is that in the fabrication of the U-shaped glass tubes 1, the center portion of a straight glass tube is heated with the aid of a burner so that the glass tube may be softened and bent into the form of U. Thereafter the inner surface of the U-shaped glass tube is coated with phosphor powder, and mounts 2*a* each with the electrode 2 is fitted into the open ends of the U-shaped glass tube 1 and fused to the tube 1 with the aid of the burner. In this case, if the distance d were less than 0.5 mm, both legs of the tube 1 would be fused together.

As to the lamp input, if the tube wall load exceeds 0.1 w/cm$^2$, the lamp life would become less than one half of a design life 5,000 hours. On the other hand, when the lamp input is less than 0.05 w/cm$^2$, the lamp output would become considerably lower than that of the incandescent lamps so that the fluorescent lamps in accordance with the present invention could not be used instead of them.

The outer diameter of the glass tube 1 is preferably between 11 and 26 mm, and the radius of curvature A, less than 15 mm.

Next some examples of the fluorescent lamps in accordance with the present invention will be described with reference to FIGS. 1–4.

EXAMPLE 1

Figure 4:
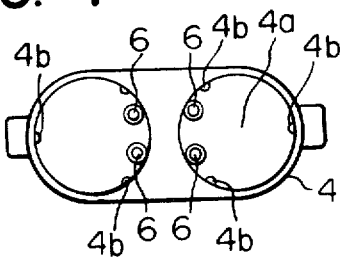
FIG. 4 is a top view of a cap or base for the fluorescent lamps in accordance with the present invention.

A straight glass tube has a wall thickness of 1.2 mm and an outer diameter of 20 mm. The center portion 1*b* of the tube is heated and bent or folded into a U-shape with the radius of curvature A of 3 mm by molding techniques. The molded glass tube 1 has the leg distance d of 2 mm and the width D of 42 mm. Thereafter the white fluorescent coating 3 is formed over the inside surface of the glass tube 1 by the deposition of for instance calcium halophosphate phosphor activated by antimony and manganese. The next step is to seal the glass tube 1 with the mounts 2*a* with the electrodes 2 in such a way that the electrode distance L may become 300 or 380 mm and consequently the ratio L/D may become 7.14 or 9.05. After the glass tube 1 is evacuated, it is filled with mercury vapor (15 mg) and argon gas (3.5 Torr). Thereafter the base 4, which is made of heat-resisting polyester resins, is securely bonded to the ends of the glass tube 1 with the adhesives 5 in such a way that the ends of the glass tube 1 may be bridged by the base 4. The base 4 is 17 mm in height, 47 mm in major axis and 24.5 mm in minor axis and, as shown in FIG. 4, is formed with two circular recesses 4*a* with a diameter of 20.9 mm and a depth of 14.1 mm. Mounting or retaining ridges 4*b* are extended from the peripheral wall of the circular recess 4*a* and equidistantly spaced apart from each other by 120°. Four base pins 6 which are made of brass are extended through the bottom wall of the cylindrical recess 4*b* as best shown in FIG. 1. Each ridge 4*b* is 1.2 mm in height and is extended vertically from the bottom of the cylindrical recess 4*a* to the point three millimeters below the open end of the recess 4*a* as best shown in FIG. 1. The size of the cap pins 6 is same with that of the cap or base G10q of I.E.C. (International Electrotechnical Commission) 7004-54-1 "Prong Cap for Circular Fluorescent Lamps".

Since the cap 4 is formed with the ridges or projections 4*b*, the shoulder portion of the sealed end of the glass tube 1 abuts agains the upper ends of the ridges or projections 4*b* when the cap 4 is fitted over the ends of the glass tube 1. As a result the cap 4 may be correctly positioned with respect to the ends of the glass tube 1. That is, a stem seal 1*c* may be prevented from striking against the bottom of the cylindrical recess 4*b* of the cap 4 and being damaged.

When the fluorescent lamp thus fabricated is combined with a holder of the type defined in I.E.C. 7005-56-1 "Holder for Circular Fluorescent Lamps" G10q, an illumination equipment may be readily provided.

The fluorescent lamps fabricated in the manner described above were connected in series to F15T8 and F20T12 choke coils (not shown) and operated at 100 V with the starters. The results of tests are summarized in Table shown in FIG. 5. It is seen that as compared with the prior art straight fluorescent lamps, the ratio L/D of the fluorescent lamps in accordance with the present invention may be reduced by about 40 to 50% without causing any degradation in lamp characteristics. That is, the fluorescent lamps in accordance with the present invention are made remarkably compact in size as compared with the prior art straight fluorescent lamps. It may be also noticed that the luminous efficiency and life of the fluorescent lamps in accordance with the present invention are considerably improved as compared with 60 W incandescent lamps whose inside surface is coated with silica and which has an average luminous efficiency of 13.5 lm/w and an average service life of 1000 hours.

The dimensions, total luminous flux and lumens per sq.cm. of the 15 W fluorescent lamps in accordance with the present invention and the prior art straight fluorescent lamp F15T8 are shown in Table in FIG. 6. It will be seen that the lumens per sq.cm. of the lamp in accordance with the present invention is considerably higher than that of the prior art fluorescent lamp. This means that the fluorescent lamps in accordance with the present invention are more compact than the prior art straight fluorescent lamps with the same wattage.

The dimensions, total luminous flux and lumens per sq.cm. of the 20 W fluorescent lamps in accordance with the present invention and the prior art straight and circular fluorescent lamps F20T12CW and FC5T9CW are shown in Table in FIG. 6. It will be also readily seen that the fluorescent lamps in accordance with the present invention are more compact than the prior art fluorescent lamps with the same wattage.

EXAMPLE 2

A straight glass tube with a wall thickness of 1.0 mm and an outer diameter of 13.5 mm is molded into a U-shaped glass tube with the width D=28 mm and the leg distance d=1 mm. Following the fabrication steps of EXAMPLE 1, the fluorescent lamps are fabricated whose specifications are same as described above except that the electrode distance is 208 mm; that is, the ratio L/D is 6.92. The lamps thus fabricated were connected in series to F6T15CW choke coils and operated at 100 V with a starter (not shown). The results of the test are shown in Table in FIG. 8. It will be seen that as compared with the prior art straight fluorescent lamps with the same wattage, the ratio L/D of the fluorescent lamps in accordance with the present invention is decreased by about 35%. Furthermore as compared with the 20 W silica coated incandescent lamps, the fluorescent lamps in accordance with the present invention consume only about one-third of the power for producing the luminous flux of higher than 170 lumens.

What is claimed is:

1. A fluorescent lamp comprising a U-shaped glass tube whose inside surface is coated with fluorescent materials and which is filled with mercury vapor and rare gas, two electrodes at the ends of said glass tube and a cap or base which bridges between said ends of said glass tube, said cap or base being formed with two cylindrical recesses each receiving an end of said U-shaped glass tube, said cap or base having terminal pins or prongs of G10q type, and a plurality of equiangularly spaced and axially extended ridges or projections extended from the peripheral wall of each of said cylindrical recesses for abutment with the end of said U-shaped glass tube, the width of said U-shaped glass tube being less than 60 mm; the distance between the legs of said U-shaped glass tube being greater than 0.5 mm, the ratio L/D being between 3 and 10, where L=the distance between said two electrodes and D=said width of said U-shaped glass tube; and the tube wall load being 0.05–0.10 w/cm$^2$.

* * * * *